United States Patent [19]

Miceli

[11] 3,936,988

[45] Feb. 10, 1976

[54] REPAIR DEVICE FOR RESTORING A DAMAGE DRY WALL BOARD

[75] Inventor: Nicholas M. Miceli, Woodside, N.Y.

[73] Assignee: Lawrence Peska Associates, Inc., New York, N.Y. ; a part interest

[22] Filed: Dec. 16, 1974

[21] Appl. No.: 532,991

[52] U.S. Cl. ..... 52/514

[51] Int. Cl.[2] ..... E02D 37/00

[58] Field of Search ..... 52/514

[56] References Cited

UNITED STATES PATENTS

| | | | |
|---|---|---|---|
| 2,638,774 | 5/1953 | Wieman | 52/514 |
| 3,690,084 | 9/1972 | Leblanc | 52/514 |
| 3,834,107 | 9/1974 | Standing | 52/514 |

*Primary Examiner*—Ernest R. Purser
*Assistant Examiner*—Carl D. Friedman
*Attorney, Agent, or Firm*—Richard E. Nanfeldt

[57] ABSTRACT

A repair device is used to restore a damaged dry wallboard, wherein a 2.5 inch or larger hole is cut out from the damaged wall. A cut out piece of wallboard of slightly smaller dimensions than the hole is used to effect the restoration in conjunction with the repair device. The repair device consists of a wallboard support member that inserts through the hole to be secured onto the inside surface of a rear drywall. The cut out piece of wallboard is secured to the board support member. A plurality of clip members are affixed onto the cutout piece of wallboard, wherein the clip members engage an inside surface of the damaged wall board. The cut out piece of wallboard is recessed inward from the front face of the damaged drywall. A user plasters material into the recess and onto the cut out piece of wallboard. The clip members and board support member become an integral part of the restored wallboard.

2 Claims, 3 Drawing Figures

REPAIR DEVICE FOR RESTORING A DAMAGE DRY WALL BOARD

SUMMARY OF THE INVENTION

My present invention relates to a unique and novel repair device used to restore a damaged dry wallboard.

A number of U.S. Pat. Nos.: 2,230,349; 2,319,129; 2,325,766; and 2,338,870 have employed devices used in conjunction with dry wallboards, but these aforementioned patents are non-applicable to my present invention.

Accordingly, it is an object of my present invention to provide a low cost means for restoring a damaged wallboard with a repair device that becomes an integral part of the restorated wallboard.

A further object of my present invention is to provide a repair device capable of being used on a drywall board having either three or four inch studding.

Briefly, my present invention consist of a repair device 10 used to restore a damaged dry wallboard, wherein a 2.5 inch or larger hole is cut out from the damaged wall. A cut out piece of wallboard of slightly smaller dimensions than the hole is used to effect the restoration in conjunction with the repair device. The repair device consists of a wallboard support member that inserts through the hole to be secured onto the inside surface of a rear drywall. The cut out piece of wallboard is secured to the board support member. A plurality of clip members are affixed onto the cutout piece of wallboard, wherein the clip members engage an inside surface of the damaged wall board. The cut out piece of wallboard is recessed inward from the front face of the damaged drywall. A user plasters material into the recess and onto the cut out piece of wallboard. The clip members and board support member become an integral part of the restored wallboard.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
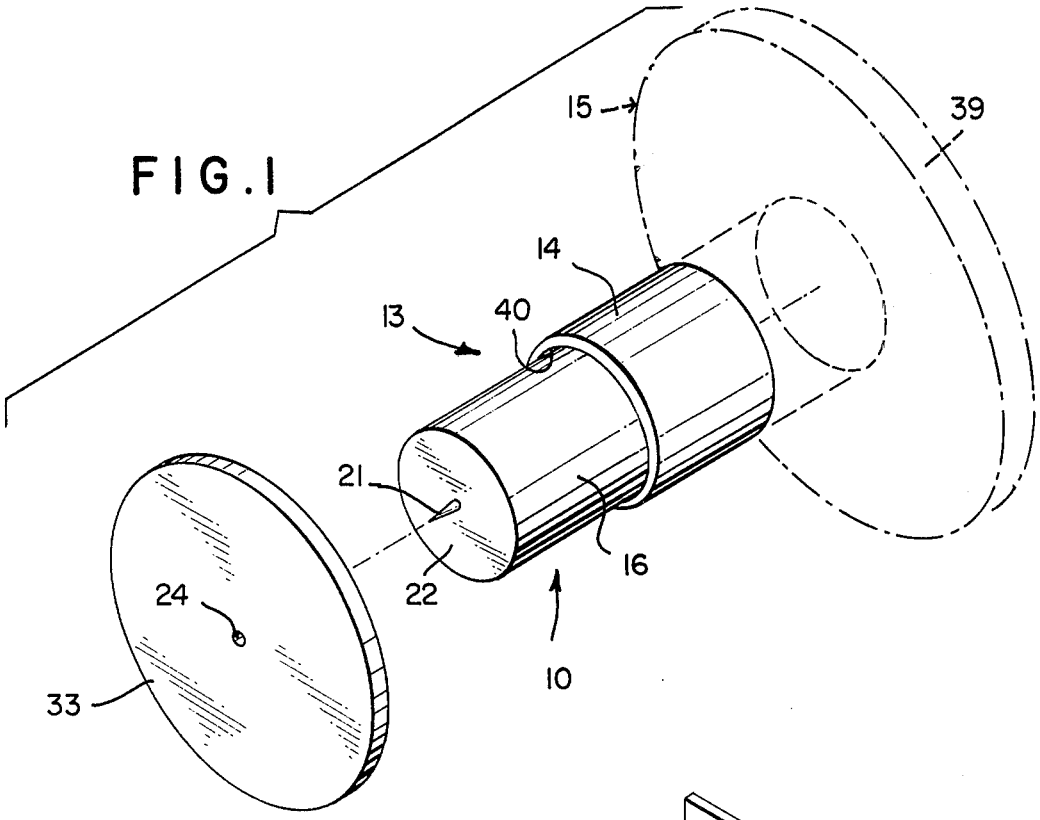
FIG. 1 illustrates a perspective view in a detached state of the wallboard support member of the repair device.
Figure 2:
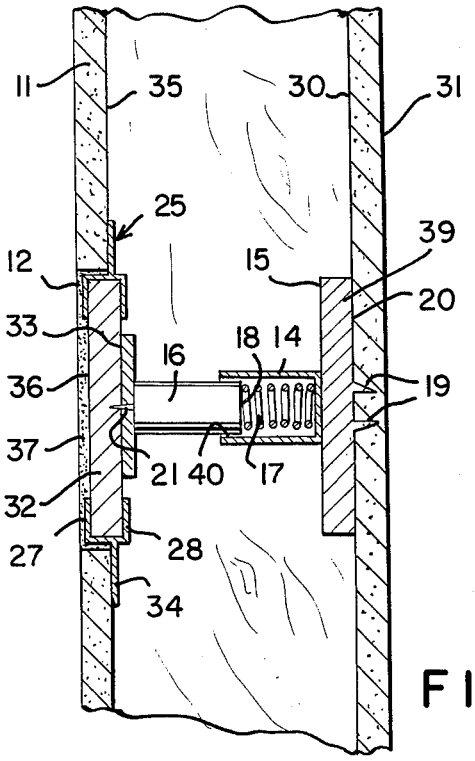
FIG. 2 illustrates a side cross sectional view of the repair device in use.

Turning now descriptively to the drawings, in which similar reference characters denote similar elements throughout the several views, FIGS. 1, 2 show a repair device 10 used as an aid in the restoration of a damaged dry wallboard 11. If a wallboard 11 is damaged, the conventional method of repair is to cut away the wallboard 11 from stud to stud which is a time consuming and costly operation. With the use of the repair device 10, the user cuts out a 2.5 inch or large hole 12 and effects repair on the hole 12. The repair device 10 consist of two components: a wallboard support member 13 and a plurality of clip members 25. The wallboard support member 13 consist of a circular bottom base plate 39 having an open ended cylindrical sleeve

14 extending upward from a center of a top face 15 of plate 39. A cylindrical rod 16 is slidably contained within a top end 40 of sleeve 14, wherein a coil tension spring 17 is contained within sleeve 14 and secured onto a bottom base 18 of rod 16. A pair of first spike members 19 extend perpendicularly outward from a bottom face 20 of plate 39. A second spike member 21 extends perpendicularly outward from the top base 22 of rod 16. A circular disc shaped element 23 having a central opening 24 therethrough engages the top base 22 of rod 16, wherein member 21 extends through opening 24.

Figure 3:
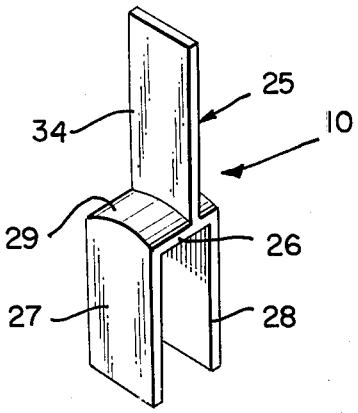
FIG. 3 illustrates a perspective view of a clip member of the repair device.

FIG. 3 shows a clip member 25 broadly consisting of a rectangular shaped center portion 26 having a pair of perpendicularly downward extending rectangular shaped flanges 27, 28 joined to the ends of portion 26. A rectangular shaped flange element 34 extend perpendicularly upward from a center top face 29 of portion 26.

In use, a hole 12 is cut out around the damaged area of the wallboard 11. The board support member 13 is inserted through hole 12, wherein the first spike members 19 are embedded into a rear drywall 31 as the bottom face 20 of plate 39 engages the inside surface 30 of the rear wallboard 31. A cutout piece of wallboard 32 of slightly smaller dimensions than hole 12 is secured onto a top base 33 of disc element 23, wherein the second spike member 33 is embedded into wallboard 32. The user pushes inward on wallboard 32 causing rod 16 to retract inward within sleeve 14 until wallboard 12 is behind the plane of wallboard 11. A plurality of clip members 25 are affixed onto wallboard 32. When pressure is removed from wallboard 32, flange element 34 engages the inside face 35 of wallboard 12. The front face 36 of wallboard 32 is recessed inwardly from the front face 38 of wallboard 12. The user plasters material into the recess 37 onto the cutout piece of wallboard thereby effecting the necessary restoration. The clip members 25 and board support member 13 become an integral part of the restored system.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United State is:

1. A repair device for repairing a damaged dry wallboard having a hole therein, which comprises:

a. a wallboard support member consisting of:

1. a circular bottom base plate,
2. a cylindrically shaped sleeve affixed perpendicularly onto a top center face of said circular bottom base plate,
3. a cylindrically shaped rod slidably contained in said sleeve and extending outwardly from an open end of said sleeve,
4. a coil tension spring contained within said sleeve and secured to said rod,
5. a plurality of first spike members extending perpendicularly outward from a bottom face of said circular plate, said spike members adapted to engage into a rear dry wallboard,
6. a second spike member extending perpendicularly outward from a top center face of said cylindrically shaped rod, 7. a circularly shaped disc element having a central hole therethrough, said disc element mounted onto said top base of said cylindrically shaped rod with said second spike extending through said central opening, said spike member adapted to engage into a cutout wallboard piece; and b. a plurality of clip members, each said clip member adapted to engage said cutout wallboard piece and adapted to engage an inside surface of said damaged dry wallboard.

2. A repair device according to claim 1, wherein each said clip member further comprises:

a. a rectangularly shaped center portion;

b. a pair of rectangularly shaped flanges joined to the ends of said center portion and extending perpendicularly downward from said ends, said cutout wallboard pieces adapted to be received between said flanges; and c. a rectangularly shaped flange element extending perpendicularly upwardly from a center top face of said center portion, said rectangularly shaped flange element adapted to engage said inside surface of said damaged dry wallboard.

* * * * *